US011452673B2

(12) United States Patent
Singh et al.

(10) Patent No.: US 11,452,673 B2
(45) Date of Patent: Sep. 27, 2022

(54) TAMPING ASSEMBLY

(71) Applicants: Scitech Centre, Mumbai (IN); ACG PAM Pharma Technologies Pvt. Ltd., Mumbai (IN)

(72) Inventors: Karan Singh, Mumbai (IN); Prakash Deshmukh, Mumbai (IN); Manish Prajapati, Mumbai (IN)

(73) Assignee: Scitech Centre and ACG PAM Pharma Technologies, Pvt. Ltd., Mumbai (IN)

( * ) Notice: Subject to any disclaimer, the term of this patent is extended or adjusted under 35 U.S.C. 154(b) by 95 days.

(21) Appl. No.: 16/556,497

(22) Filed: Aug. 30, 2019

(65) Prior Publication Data

US 2020/0078269 A1 Mar. 12, 2020

(30) Foreign Application Priority Data

Sep. 6, 2018 (IN) ..... 201821033567

(51) Int. Cl.
*A61J 3/07* (2006.01)
*B65B 1/24* (2006.01)

(52) U.S. Cl.
CPC ..... *A61J 3/074* (2013.01); *B65B 1/24* (2013.01)

(58) Field of Classification Search
CPC ..... A61J 3/06–074; B65B 1/24
See application file for complete search history.

(56) References Cited

U.S. PATENT DOCUMENTS 3,186,910 A * 6/1965 Glassman ..... A61J 3/074 53/452
3,324,902 A * 6/1967 Lense ..... A61J 3/074 141/1
4,009,239 A * 2/1977 Bowen ..... B30B 11/04 264/153
4,731,979 A * 3/1988 Yamamoto ..... A61J 3/074 53/529
6,425,422 B1 * 7/2002 Trebbi ..... B65B 1/363 141/144
6,499,279 B1 * 12/2002 Yamamoto ..... A61J 3/074 53/328
10,889,394 B2 * 1/2021 Ghiotti ..... B65B 1/06
10,913,554 B2 * 2/2021 Rea ..... B65B 1/36
(Continued)

*Primary Examiner* — Anna K Kinsaul
*Assistant Examiner* — Himchan Song

(57) ABSTRACT

A tamping assembly for a capsule filling machine is provided. The tamping assembly comprising a dosing disc provided with a plurality of sets of through vertical passages placed substantially equidistantly around the periphery thereof; a bottom plate disposed below the dosing disc, the bottom plate having an open region aligned with a carousel of the capsule filling machine disposed adjacent to the tamping assembly, and a set of apertures aligned with at-least one set of through vertical passages of the dosing disc; a plurality of sets of top tamping plungers disposed above the dosing disc, each set of top tamping plungers configured to be driven downwards for pressing a powdered product in the vertical passages from the top; and at-least one set of bottom tamping plungers disposed below the bottom plate and configured to be driven upwards for pressing the powdered product in the vertical passages from the bottom.

4 Claims, 5 Drawing Sheets

(56) References Cited

U.S. PATENT DOCUMENTS

| | | | | |
|---|---|---|---|---|
| 2004/0003866 | A1* | 1/2004 | Rocchio | B65B 1/24 141/73 |
| 2004/0113319 | A1* | 6/2004 | Kondo | A61K 9/2095 264/319 |
| 2005/0217752 | A1* | 10/2005 | Facchini | A61J 3/074 141/146 |
| 2008/0216452 | A1* | 9/2008 | Moodley | B65B 25/145 53/454 |
| 2008/0219803 | A1* | 9/2008 | Runft | A61J 3/074 414/21 |
| 2009/0130243 | A1* | 5/2009 | Inoue | B30B 11/02 425/344 |
| 2011/0088355 | A1* | 4/2011 | Fulper | A61J 3/074 53/111 R |
| 2011/0318411 | A1* | 12/2011 | Luber | A61K 31/4545 514/648 |
| 2012/0319328 | A1* | 12/2012 | Ando | A61J 3/10 264/319 |
| 2019/0008781 | A1* | 1/2019 | Puckett | A61K 9/4833 |

* cited by examiner

TAMPING ASSEMBLY

CROSS-REFERENCE TO RELATED APPLICATION

This application claims the benefit of Indian Application Serial No. 201821033567, filed on Sep. 6, 2018, entitled "A TAMPING ASSEMBLY," commonly assigned with this application and incorporated herein by reference in its entirety.

FIELD OF THE DISCLOSURE

The disclosure relates to a tamping assembly for a capsule filling machine.

BACKGROUND OF THE DISCLOSURE

Capsules containing pharmaceutical formulations in the form of products such as micro-tablets, mini tablets, tablets, caplets, soft gels, pellets, spherical balls and filled capsules are known and generally used for controlled drug delivery. Capsule filling machines are widely used to precisely fill such pharmaceutical formulations in gelatin capsules.

Typically, a capsule filling machine comprises of a central turret or carousel with capsule handling units and plurality of processing or operating stations positioned around periphery of the turret. The turret rotates intermittently, carrying the capsule handling unit to each of the processing or operating stations. Each of the processing stations has equipment or machinery to carry out a dedicated operation. Such operations includes capsule loading, capsule opening, capsule filling—powder filling or pellet filling, capsule closing, capsule rejection and capsule ejection.

Equipment or machinery at the processing station for powder filling comprises a tamping assembly. The tamping assembly comprises of a hopper, a container, a dosing disc, a bottom plate, and plurality of set of top tamping plungers. The powder to be filled in the capsules is first loaded into a hopper which is then transferred to the container. The dosing disc is provided with a plurality of sets of through vertical passages which are equidistantly placed around the periphery of the dosing disc. The bottom plate is provided below the dosing disc so as to close the vertical passages in the dosing disc at the bottom thereof expect the vertical passages which align with the capsule handling unit. Mounted above the dosing disc are the plurality of sets of vertical plungers (pistons) disposed in the same layout as the sets of vertical passages in the dosing disc. The plungers are height adjustable and movable up and down. The lower ends of the plungers are profiled to pass through the vertical passages.

In a cycle of operation of the machine, one set of vertical passages of the dosing disc is filled up with the powdery product and respective set of plungers move down and press the powdery product to form a slug into the corresponding sets of vertical passages in layers or stages of increased quantity until the last set of the vertical passages among the remaining set of vertical passages is completely filled with the powdery product to the required dose. This is called the tamping operation. Following this the plungers move up and the carousels rotate by a predetermined angle. This is called the indexing operation. The said last set of the vertical passages among the remaining set of vertical passages filled with the powdery product to the required dose aligns with a capsule handling unit and the cycle product to the required dose, moves back to its original position, the capsule bottoms are closed with the capsule tops in the respective upper capsule holder and the closed capsules are expelled from the capsule handling carousel. While, tamping is achieved with the aforementioned setup, tamping is performed only from the top, and the slug formed is not uniformly compressed and may lack desired stiffness. Typically, at-least six tamping stations are required to form the slug of required/desired constitution, at-least in terms of uniformity and/or stiffness. Six tamping stations would require six set of tamping plungers, and a dosing disc with six sets of corresponding vertical passages. This leads to an increase in size and weight of the dosing disc, which is undesirable. Increase in size would also result in more leftover powder, which results in wastage. Further, the size of the overall machine thus increases with six tamping stations. Also, when the dosing requirement changes, the dosing disc has to be changed. Thus, it is common to have different types of dosing disc stored at site. However, since dosing disc with six set of passageways is considerably big, the same is difficult to store. In view of the aforementioned, there is a need in the art to address at-least the aforementioned issues.

SUMMARY OF THE DISCLOSURE

Accordingly, the present disclosure in one aspect provides a tamping assembly for a capsule filling machine, the tamping assembly comprising a dosing disc provided with a plurality of sets of through vertical passages placed equidistantly around the periphery thereof; a bottom plate disposed below the dosing disc to close the vertical passages at the bottom thereof, the bottom plate having an open region aligned with a carousel of the capsule filling machine disposed adjacent to the tamping assembly; and a set of apertures aligned with at-least one set of through vertical passages of the dosing disc; plurality of sets of top tamping plungers disposed above the dosing disc, the set of top tamping plungers aligned with each set of through vertical passages of the dosing disc and configured to be driven downwards for pressing a powdered product in the passages from the top; and at-least one set of bottom tamping plungers disposed below the bottom plate, the set of bottom tamping plungers provided to close each set of apertures of the bottom plate and/or corresponding vertical passages of the dosing disc, and configured to be driven upwards for pressing the powdered product in the vertical passages from the bottom.

BRIEF DESCRIPTION OF THE DRAWINGS

Reference will be made to embodiments of the disclosure, examples of which may be illustrated in accompanying figures. These figures are intended to be illustrative, not limiting. Although the disclosure is generally described in context of these embodiments, it should be understood that it is not intended to limit the scope of the disclosure to these particular embodiments.

DETAILED DESCRIPTION OF THE DISCLOSURE

The present disclosure is directed towards a tamping assembly for a capsule filling machine, whereby a slug is formed by compressing a powdery product from top and bottom.

Figure 1:
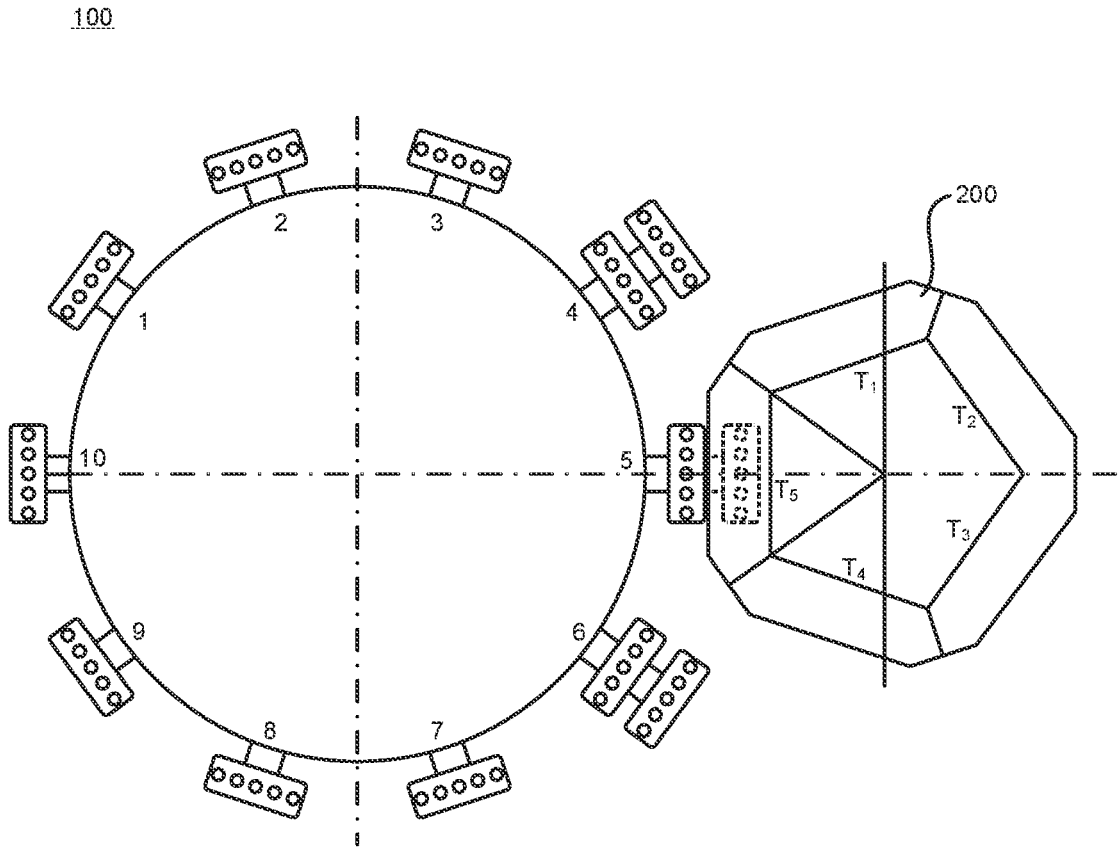
FIG. 1 shows a capsule filling machine in accordance with an embodiment of the disclosure.

FIG. 1 shows a capsule filling machine 100 in accordance with an embodiment of the disclosure. The capsule filling machine comprises a central turret or carousel and plurality of processing stations 1 to 10 or more as per requirement positioned around periphery of the turret. The turret is provided with plurality of capsule handling units disposed equidistantly around the periphery thereof. Each of the capsule handling unit comprises two superimposed capsule holders (bodies). The upper capsule holders are fixed to the carousel and are provided with bushes or seatings to hold the capsule tops and the lower capsule holders are provided with bushes or seatings to hold the capsule bottoms. The turret rotates intermittently, carrying the capsule handling unit to each of the processing stations.

Processing station denoted by numeral 1 is a capsule loading stations where empty gelatin capsules are supplied. Processing station denoted by numeral 3 is a capsule opening station where cap and body segments of capsules are separated. Processing station denoted by numeral 4 to 7 are filling stations where products such as powder, pellets, tablet etc. are filled in the capsules. As per the present disclosure, the capsule filling machine is configured for powder filling in capsules. Processing station denoted by 5 is a powder filling station where powder is filled by a tamping assembly 200. The tamping assembly has five tamping stations T1 to T5. Processing station denoted by numeral 8 is a capsule closing station where split capsule holders are joined again ensuring the capsule cap fits on the capsule body and closes the capsule, after which the capsules are ejected at processing station 9. Processing station 10 is provided for cleaning of cap and body bushes by air and vacuum. It will be appreciated that, in the system illustrated through the figures a total of ten processing stations are provided, the number of processing stations may be varied depending upon requirement.

Figure 2:
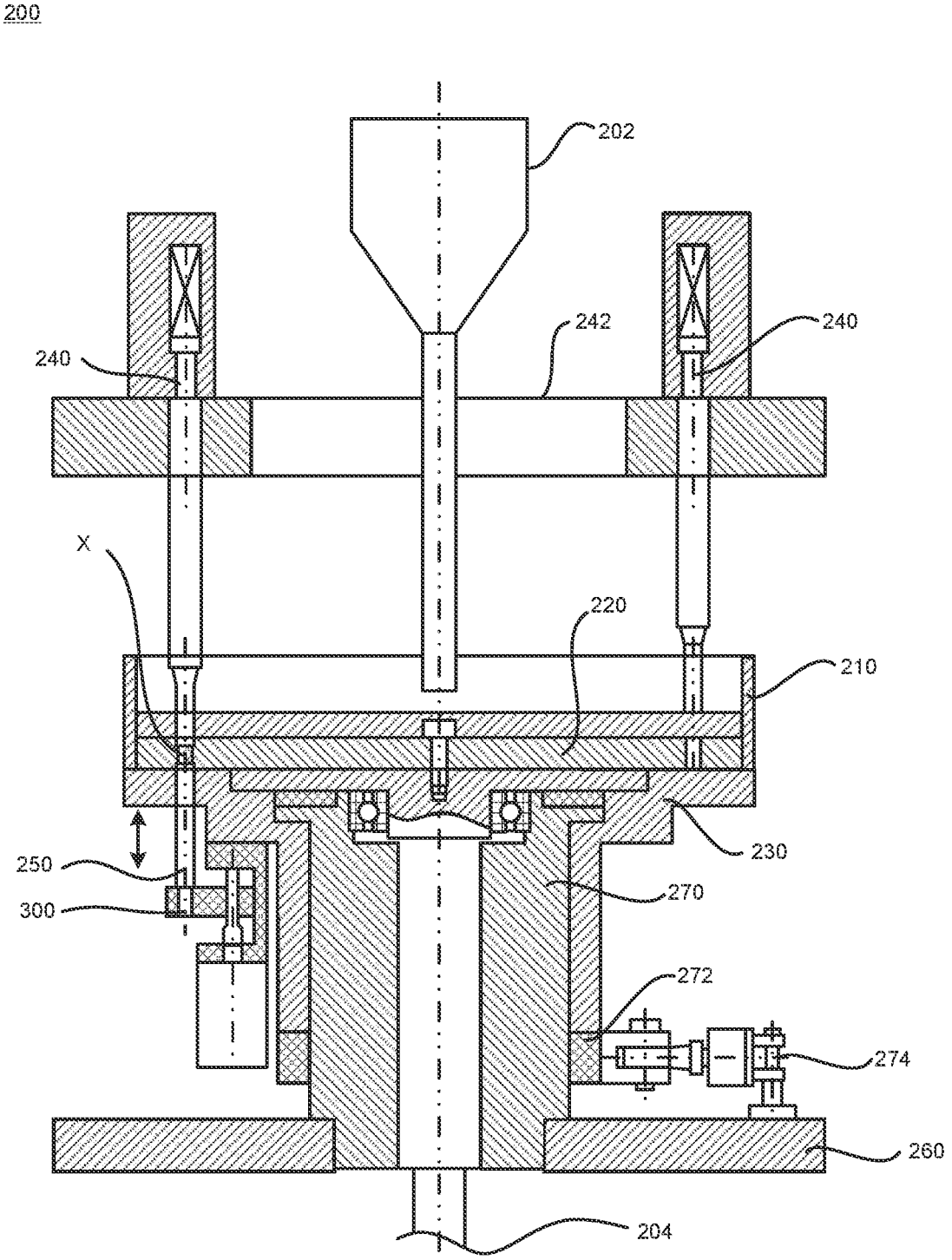
FIG. 2 shows a tamping assembly in accordance with an embodiment of the disclosure.

FIG. 2 shows a tamping assembly 200 in accordance with an embodiment of the disclosure. As discussed hereinbefore, the capsule filling machine is configured for filling powdered products. Accordingly, the processing station 5 will include the tamping assembly as per FIG. 2. The tamping assembly comprises of a powder tub 210, a dosing disc 220, a bottom plate 230, plurality of sets of top tamping plungers 240 and at-least one set of bottom tamping plungers 250.

The powder to be filled in the capsules is first loaded into a hopper 202 which is then transferred to the powder tub. The powder tub is mounted on a platform 260. In between the powder tub and the platform a housing 270 is provided for enclosing various components of the tamping assembly.

The dosing disc has plurality of sets of through vertical passages. The dosing disc is rotatably mounted on a vertical shaft 204 and is configured to move/rotate sequentially, whereby the vertical shaft is driven by an indexing unit to rotate the dosing disc intermittently.

The bottom plate is disposed below the dosing disc. The bottom plate is movable up and down. A nut 272 is provided for moving the bottom plate up and down, whereby a pneumatic cylinder 274 drives the nut. The bottom plate is moved up and down to generate a gap between the dosing disc and the bottom plate to allow the dosing disc to rotate. The bottom plate has an opening aligned with the carousel which is adjacent to the tamping assembly; and a set of apertures aligned with at-least one set of through vertical passage of the dosing disc. In the remaining areas, the bottom plate closes the vertical passages of the dosing disc at the bottom thereof.

The dimensions of the vertical passages of the dosing disc and the apertures of the bottom plate are a function of the mass of the doses of the powdery product to be filled in the capsules and a function of the dimensions of the capsules themselves.

As shown, the set of top tamping plungers are provided above the dosing disc, and the set of bottom tamping plungers are provided below the bottom plate.

The sets of top tamping plungers are disposed above the dosing disc. The sets of top tamping plungers is adapted to a movable plate 242 or platform whereby the movable plate is lowered or lifted to move the sets of top tamping plungers. A drive is provided for lowering/lifting the movable plate, and thereby the plurality of sets of top tamping plungers. Each set of top tamping plunger is aligned with each set of through vertical passages of the dosing disc for pressing a powdered product in the passages. Basically, the tamping plungers are placed in the same layout as the sets of vertical passages in the dosing disc. The set of top tamping plungers form different tamping stations of dosing disc during its intermittent rotation. Each of the sets of the tamping plungers have the same stroke, however each set of the tamping plungers may vary in height. Further, each set of top tamping plungers has plurality of tamping plungers. As shown in FIG. 2, the tamping plungers extend from a top end to a lower end. The lower ends of the bottom tamping plungers are profiled to pass through the vertical passages of the dosing disc and press a powdery product from the top to form a slug X.

Further, at-least one set of bottom tamping plungers are disposed below the bottom plate whereby one set of bottom tamping plunger is aligned with at-least one set of apertures of the bottom plate. Basically, the set of bottom tamping plungers is placed such that it has the same layout as one set of apertures of the bottom plate. The number of sets of bottom tamping plungers is variable and can be selected as per requirement. Further, each set of bottom tamping plungers has plurality of tamping plungers. The tamping plungers extend from a lower end to a top end. The top ends of the bottom tamping plungers are profiled to cover the apertures as well as pass through the aperture and the vertical passage to press the powdery product from the bottom to further compress the slug. The slug thus formed is uniformly compressed from top as well as the bottom as shown in FIG. 2. The slug formed is also harder.

Figure 3:
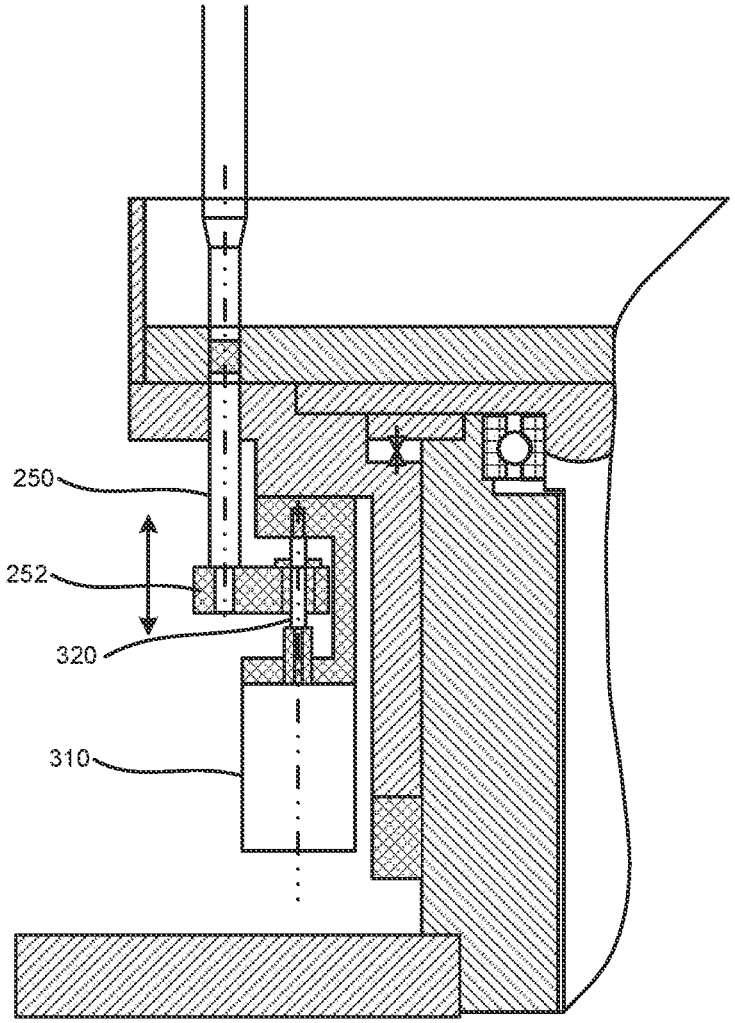
FIG. 3 shows a drive mechanism in accordance with an embodiment of the disclosure.

FIG. 3 shows a drive mechanism 300 for the set of bottom tamping plungers. As shown in FIGS. 2 and 3, the drive mechanism is coupled with the set of bottom tamping plungers enabling the set of bottom tamping plungers to move upwards and downwards. The drive mechanism comprises of a servo drive 310, and a lifting screw 320. The lifting screw has a shaft and a nut adapted on the shaft. The shaft and nut has matching helical grooves whereby the nut moves on the shaft upon rotation of the shaft. The nut is interconnected with the bottom tamping plungers via a flange or a plate. Accordingly, as the shaft is rotated, the nut travels on the shaft moving the set of bottom tamping plungers. In this regard, the shaft is connected with a shaft of the servo drive. As shown in the figure, the shaft of the lifting screw is vertically disposed, and the flange or nut extends perpendicularly from the shaft. Accordingly, the movement of the shaft results in vertical movement of the nut. Thus, the set of bottom tamping plungers get lifted or lowered as the shaft is rotated.

Figure 4A:
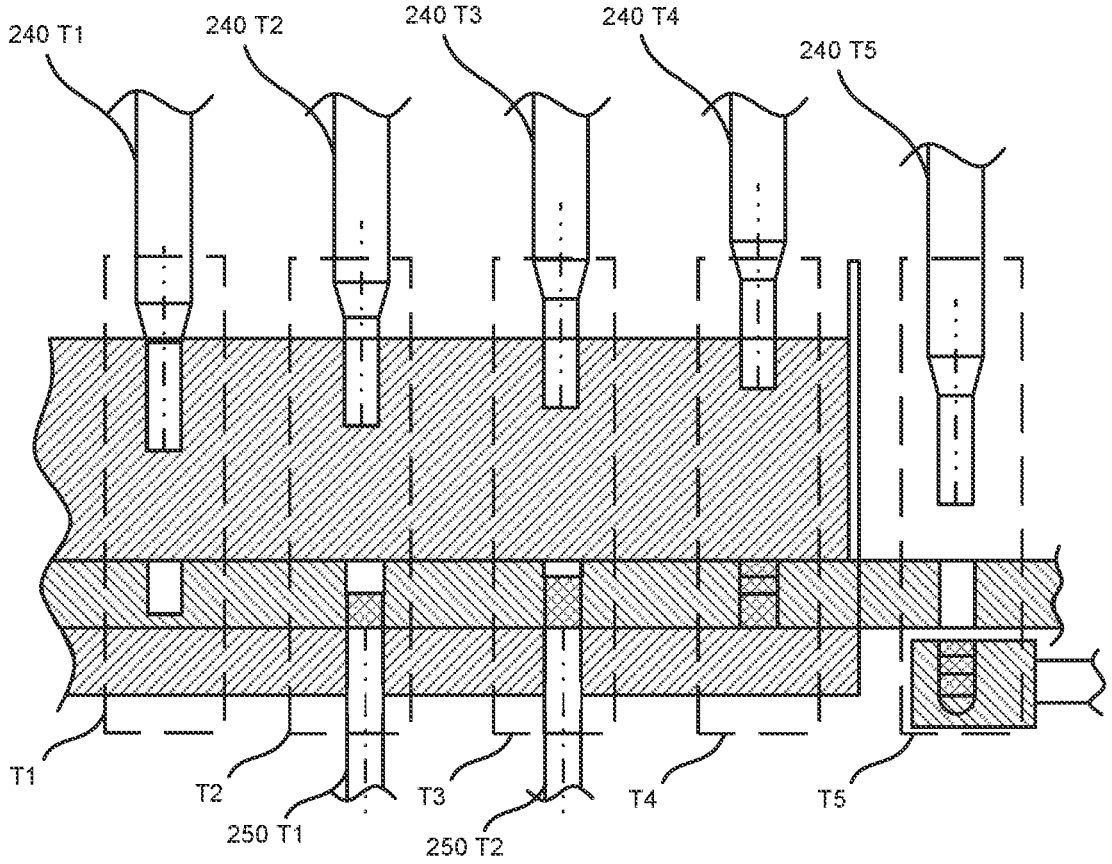
FIGS. 4A and 4B show an illustrative representation of the sequence of tamping operations carried out on the tamping assembly in accordance with an embodiment of the disclosure.
Figure 4B:
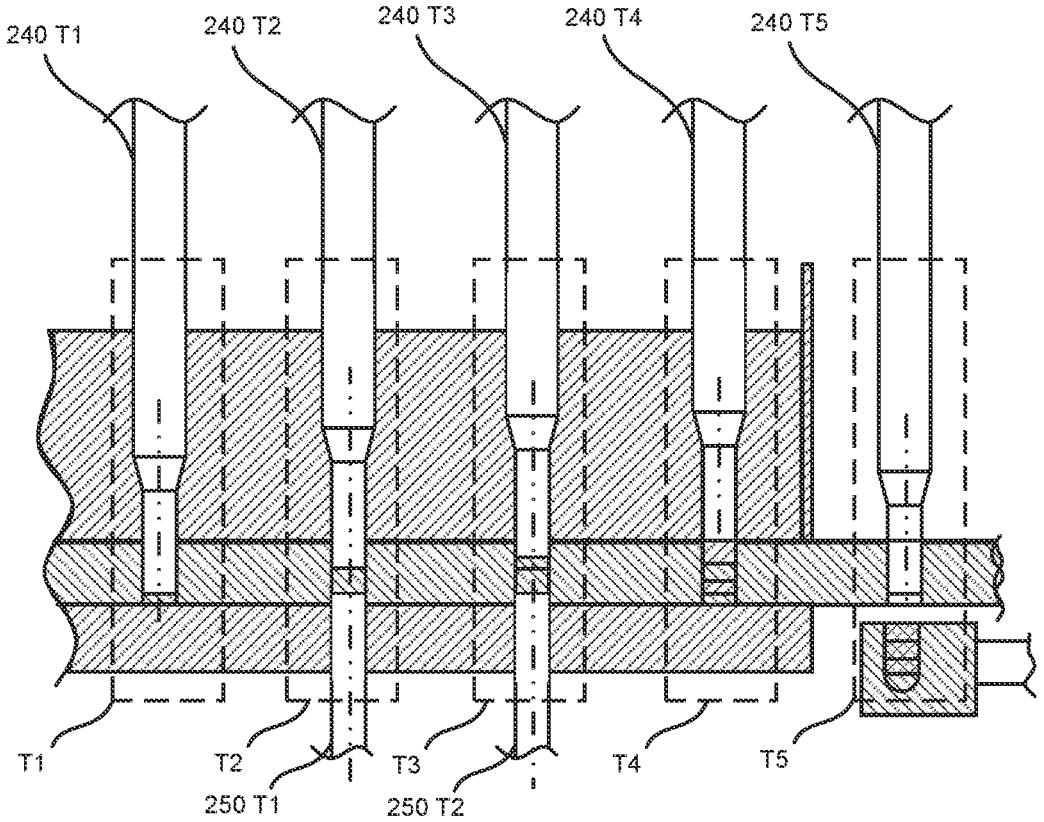

FIGS. 4*a* and 4*b* show an illustrative representation of the sequence of tamping operations carried out on the tamping assembly in accordance with an embodiment of the disclosure. As mentioned hereinbefore, the tamping assembly has plurality of sets of top tamping plungers and at-least one set of bottom tamping plungers. As shown in FIGS. 4*a* and 4*b*, the tamping assembly has five tamping stations—a first tamping station T1, a second tamping station T2, a third tamping station T3, a fourth tamping station T4 and a fifth tamping station T5. As shown, first tamping station to fifth tamping station has set of top tamping plungers 240T1 to 240T5, and the second and third tamping station also have bottom tamping plungers 250T1, 250T2. Accordingly, the dosing disc has five of sets of through vertical passages, and, the bottom plate has two sets of apertures. In that, the sets of top vertical plungers are disposed in the same layout as the five sets of vertical passages in the dosing disc, and the sets of bottom vertical plungers are disposed in the same layout as the two sets of apertures of the bottom plate. The tamping assembly gradually forms a slug by a series of tamping operations carried out by the top tamping plungers and the bottom tamping plungers.

In a cycle of operation, at the first station, the set of top tamping plungers move down and expel a powdery product in the dosing disc and tamp said powder to form a slug. Following this the top tamping plungers move up and the dosing disc rotates by a predetermined angle to the next tamping station—second station. At the second tamping station set of top tamping plungers move down and expel more of the powdery product in the dosing disc and tamp said powder further. Also, as shown in FIG. 4B, the bottom tamping plungers move up and press the loose slug further, thus making it more stiff. The set of top tamping plungers and the set of bottom tamping plungers at the second station can be configured to move simultaneously or sequentially. At the third tamping station, the respective set of top tamping plungers move down and expel more of the powdery product in the dosing disc and tamp said powder further. Also, as shown in FIG. 4B, the bottom tamping plungers move up and press the loose slug formed in previous stations (first station and second station) more stiff. The set of top tamping plungers and the set of bottom tamping plungers at the second station can be configured to move simultaneously or sequentially. At the fourth tamping station, the fourth set of top tamping plungers move down and press the powdery product in the powdery product holder into the corresponding set of vertical passages in layers or stages of increased quantity until the last set of the vertical passages among the remaining set of vertical passages is completely filled with the powdery product to the required dose. At the fifth tamping station, the said last set of the vertical passages among the remaining set of vertical passages filled with the powdery product to the required dose aligns with a capsule handling unit and eject the slug formed into the capsule and the cycle repeats. Thus, a slug with desired stiffness and uniformity is formed with five tamping stations instead of six tamping stations. Further, five tamping stations reduces the overall size of the dosing disc, and thereby the assembly, and obviates other disadvantages associated with the existing machines. It will be appreciated that the number of tamping stations can be further reduced by employing top and bottom plungers at more tamping stations.

While the present disclosure has been described with respect to certain embodiments, it will be apparent to those skilled in the art that various changes and modification may be made without departing from the scope of the disclosure as defined in the following claims.

What is claimed is:

1. A tamping assembly for a capsule filling machine, the tamping assembly comprising:

a dosing disc provided with a plurality of sets of through vertical passages placed substantially equidistantly around the periphery thereof;

a bottom plate disposed below the dosing disc to close the vertical passages at the bottom thereof, the bottom plate having a set of apertures aligned with at-least one set of the plurality of sets of through vertical passages of the dosing disc, wherein the bottom plate is configured to move up and down to generate a gap between the dosing disc and the bottom plate to allow the dosing disc to rotate;

a plurality of sets of top tamping plungers disposed above the dosing disc, each of the plurality of sets of the top tamping plungers aligned with an associated set of through vertical passages of the dosing disc and configured to be driven downwards for pressing a powdered product in the vertical passages from the top, wherein the plurality of sets of the top tamping plungers are adapted to a movable plate, wherein the movable plate is lowered or lifted to move the plurality of sets of the top tamping plungers; and at-least one set of bottom tamping plungers disposed below the bottom plate, the at-least one set of the bottom tamping plungers provided to close each set of apertures of the bottom plate and/or corresponding vertical passages of the dosing disc, and configured to be driven upwards for pressing the powdered product in the vertical passages from the bottom.

2. The tamping assembly as claimed in claim 1, wherein a drive mechanism is coupled with the plurality of sets of the top tamping plungers.

3. The tamping assembly as claimed in claim 1, wherein a drive mechanism is coupled with the at-least one set of the bottom tamping plungers.

4. The tamping assembly as claimed in claim 3, wherein the drive mechanism comprises a servo motor connected with a lifting screw for rotating the lifting screw, the lifting screw coupled with the at-least one set of the bottom tamping plungers to move the at-least one set of the bottom tamping plungers along a vertical direction thereof.

* * * * *